US006996890B2

(12) United States Patent
Frey

(10) Patent No.: US 6,996,890 B2
(45) Date of Patent: Feb. 14, 2006

(54) HOLDING DEVICE FOR A TARPAULIN-LIKE OR CLOTH-LIKE OBJECT TO BE PROCESSED

(76) Inventor: Helmut Frey, Birkenweg 16, 66333 Voelklingen (DE)

( * ) Notice: Subject to any disclaimer, the term of this patent is extended or adjusted under 35 U.S.C. 154(b) by 0 days.

(21) Appl. No.: 10/783,445

(22) Filed: Feb. 20, 2004

(65) Prior Publication Data

US 2004/0211045 A1 Oct. 28, 2004

Related U.S. Application Data

(63) Continuation of application No. PCT/DE02/02347, filed on Jun. 28, 2002.

(30) Foreign Application Priority Data

Aug. 20, 2001 (DE) ..... 201 13 350 U

(51) Int. Cl.
*B23P 19/04* (2006.01)

(52) U.S. Cl. ..... 29/566; 29/33 R

(58) Field of Classification Search ..... 29/566, 29/33 R, 564, 564.1, 33 K, 267, 243.53, 29/243.528, 243.521
See application file for complete search history.

(56) References Cited

U.S. PATENT DOCUMENTS

| | | | | |
|---|---|---|---|---|
| 1,945,892 | A | 2/1934 | Gobin | |
| 2,518,545 | A | 8/1950 | William et al. | |
| 4,088,004 | A * | 5/1978 | Di Maio et al. | 29/243.528 |
| 4,864,840 | A * | 9/1989 | Perez | 29/243.521 |
| 5,488,767 | A | 2/1996 | Franovick | |
| 6,450,931 | B1 * | 9/2002 | Frey | 29/243.53 |

FOREIGN PATENT DOCUMENTS

| | | |
|---|---|---|
| GB | 338133 | 11/1930 |
| WO | WO 99/26506 | 6/1999 |

* cited by examiner

*Primary Examiner*—Boyer D. Ashley
*Assistant Examiner*—Dana Ross
(74) *Attorney, Agent, or Firm*—Collard & Roe, P.C.

(57) ABSTRACT

The invention relates to a holding device for a tarpaulin-like or cloth-like object to be processed.

To provide a holding device that means are provided for releasably pressing at least a part of the object to be processed against a processing head connectable with the holding device, said means being releasable from the contact position via an actuating lever, it is suggested within the scope of the invention that means are provided for releasably pressing at least a part of the object to be processed against a processing head connectable with the holding device, said means being releasable from the contact position via an actuating lever.

6 Claims, 2 Drawing Sheets

HOLDING DEVICE FOR A TARPAULIN-LIKE OR CLOTH-LIKE OBJECT TO BE PROCESSED

CROSS REFERENCE TO RELATED APPLICATIONS

The Application is a Continuation of and priority is claimed under 35 U.S.C. 120 of International Patent Application No. PCT/DE02/02347 filed on Jun. 28, 2002. Applicant also claims priority under 35 U.S.C. §119 of Application No. DE 201 13 350.4 filed on Aug. 20, 2001.

The invention relates to a holding device for a tarpaulin-like or cloth-like object to be processed.

From the applicant's WO 99/26506, a device is known for removing eyelets, especially from webs of textile fabric or plastics. This device can also be used to set eyelets in such webs of fabric or plastics.

However, holding the web of textile fabric or plastics during the processing step has proved difficult; firstly, this can result firstly in inaccurate work and secondly, it slows down the process substantially. The object of this invention is thus to provide a device with which tarpaulin-like or cloth-like objects can be held while being processed.

This object is established by providing a means for releasably pressing at least a part of the object to be processed against a processing head connectable with the holding device, said means being releasable from the contact position via an actuating lever, and by providing the holding device with a first hand grip for one of the operator's hands, a second hand grip for the operator's other hand and, preferably within reach of the second hand grip, the actuating lever.

This device makes it possible to securely hold the flat-spread object to be processed, thus reducing processing time and improving the accuracy.

Since the holding device is operated with two hands, its weight is easier to accommodate over an extended period of time, and in addition, the device can be opened via the actuating lever located near one of the hand grips.

According to one version of the invention, the means for releasably applying pressure is engineered as a bent component pretensioned towards the processing head. During the processing step, this bent component presses the flat-spread object firmly against the processing head and holds it securely in position there. Subsequently, the bent component is released from the contact position by way of the actuating lever, and the flat-spread object is moved on (to the next eyelet) or else replaced by another flat-spread object.

It is expedient in this case if the bent component consists of wire, especially spring steel wire.

In another version of the invention, the means for releasably applying pressure is engineered as a pressing member that is pretensioned towards the processing head by means of a spring.

Here the device works in a similar manner, except that the pretensioning of the bent component is replaced by the tension of the pressure spring.

It is also to advantage if the means for releasably applying pressure to at least a part of the object to be processed is located preferably on the upper side of the holding device.

It is within the scope of the invention that the processing head is part of a device for the removal and setting of eyelets, and that the object is a tarpaulin provided or to be provided with eyelets.

The main advantages of the invention consist in the provision of an easily operated device which, in combination with a device for the removal and setting of eyelets, allows tarpaulins to be processed substantially faster and hence more economically, irrespective of whether eyelets are being set or removed.

An embodiment of the invention will now be explained by reference to the drawings.

Figure 1:
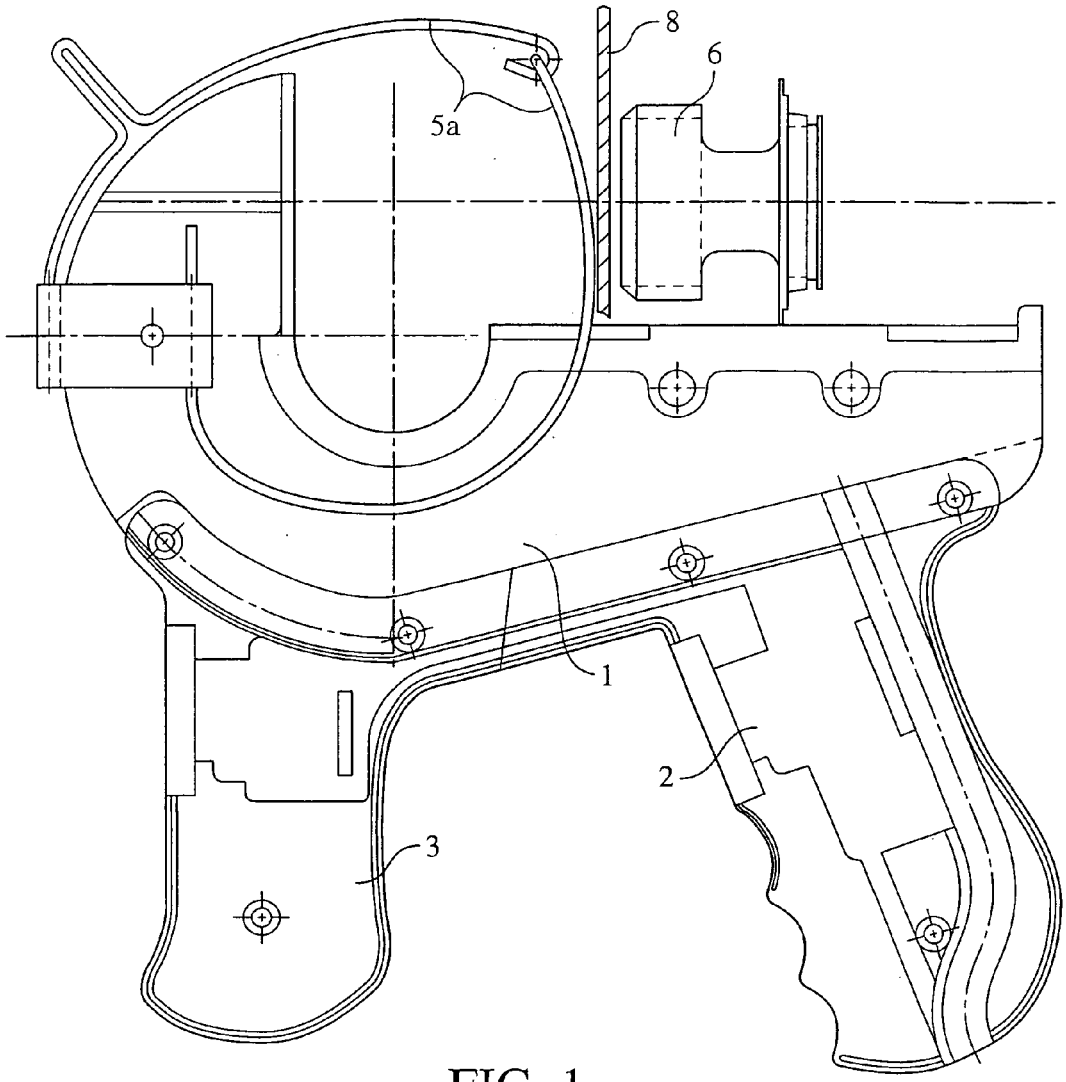
FIG. 1 shows a device according to the invention, having a pretensioned bent component.
Figure 1A:
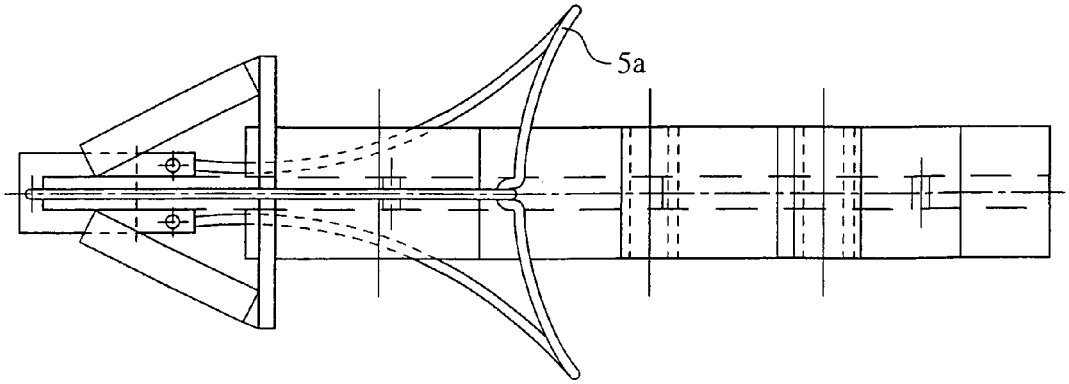
FIG. 1A shows a top view of FIG. 1.
Figure 2:
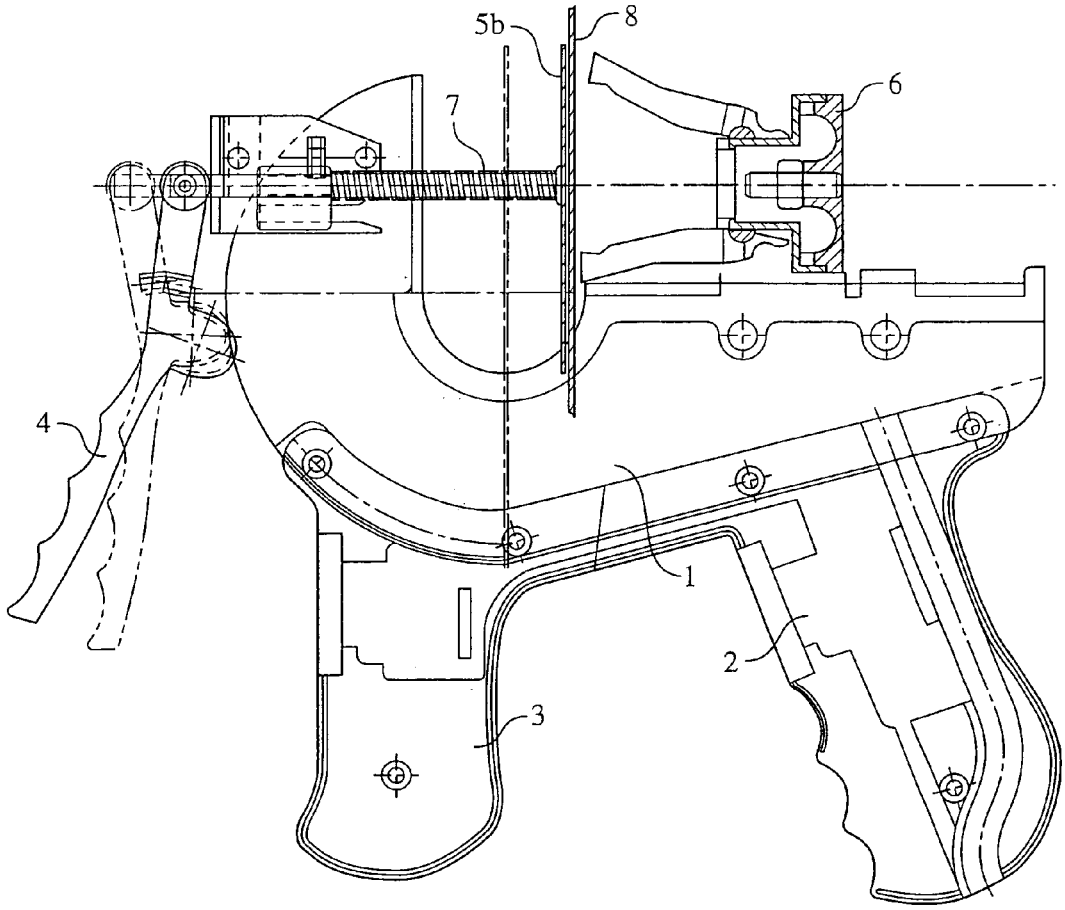
FIG. 2 shows a device according to the invention, having a pressing member pretensioned by a spring.
Figure 2A:
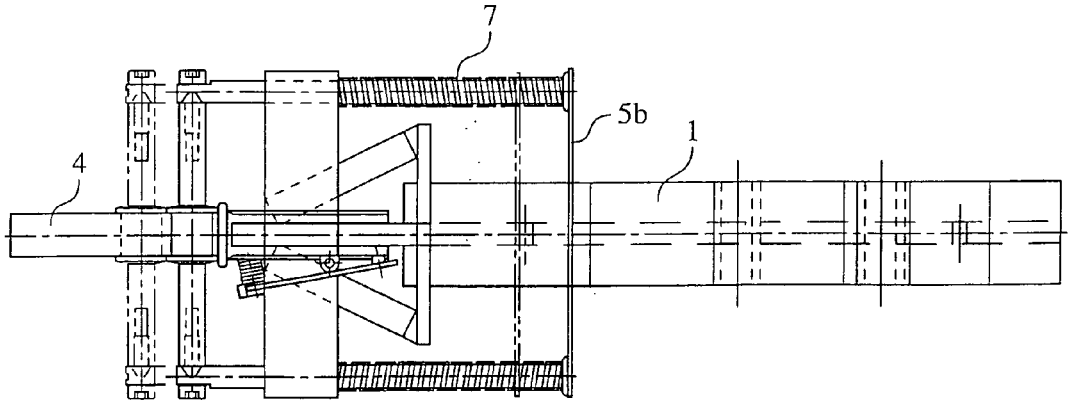
FIG. 2A shows a top view of FIG. 2.

As is evident from FIGS. 1 and 2, the device of the invention consists of a body 1 which, on its lower side, has a first hand grip 2 for one of the operator's hands and a second hand grip 3 for the operator's other hand. The body 1 also has an actuating lever 4 which is positioned within reach of the second hand grip 3 and by means of which the means 5 for releasably applying pressure can be released.

This means 5 for releasably applying pressure can, for example, be engineered as a bent component 5*a*, consisting for instance of spring steel wire, which is pretensioned towards the processing head 6 of a device for removing and setting eyelets, in particular for accurately centering the tarpaulin during punching of holes therein (FIG. 1), or as a pressing member 5*b* that is pretensioned towards the processing head 6 by a spring 7 (FIG. 2).

In both cases, the tarpaulin-like or cloth-like object 8 is held flat against the processing head 6 during the processing step, and is released again from this contact position when the actuating lever 4 is actuated.

What is claimed is:

1. A holding device for an article to be processed comprising:

(a) an actuating lever;

(b) means for removably pressing at least a part of the article to be processed against a processing head connectable with the holding device, said means being removable from a contact position via said actuation lever and comprising a pressing member pretensioned towards the processing head by a spring;

(c) a first hand grip for one hand of an operator; and (d) a second hand grip for another hand of the operator;

wherein the processing head is part of a device for the removal or setting of eyelets and for punching holes in the article, and the article is a tarpaulin provided with or to be provided with eyelets.

2. The holding device of claim 1, wherein said means for removably pressing is located on an upper side of the holding device.

3. The holding device of claim 1 wherein said actuating lever is within reach of said second hand grip.

4. A holding device for an article to be processed comprising:

(a) an actuating lever;

(b) means for removably pressing at least a part of the article to be processed against a processing head connectable with the holding device, said means being removable from a contact position via said actuation lever and comprising a bent component pretensioned towards the processing head;

(c) a first hand grip for one hand of an operator; and (d) a second hand grip for another hand of the operator;

wherein the processing head is part of a device for the removal or setting of eyelets and for punching holes in the article, and the article is a tarpaulin provided with or to be provided with eyelets.

5. The holding device of claim 4, wherein the bent component comprises wire.

6. The holding device of claim 5 wherein said bent component comprises spring steel wire.

* * * * *